US010081981B2

(12) United States Patent
Finegan

(10) Patent No.: US 10,081,981 B2
(45) Date of Patent: Sep. 25, 2018

(54) LADDER WITH LIGHTS

(71) Applicant: William Finegan, Philadelphia, PA (US)

(72) Inventor: William Finegan, Philadelphia, PA (US)

( * ) Notice: Subject to any disclaimer, the term of this patent is extended or adjusted under 35 U.S.C. 154(b) by 0 days.

(21) Appl. No.: 15/016,648

(22) Filed: Feb. 5, 2016

(65) Prior Publication Data

US 2016/0230461 A1 Aug. 11, 2016

Related U.S. Application Data

(60) Provisional application No. 62/113,482, filed on Feb. 8, 2015.

(51) Int. Cl.

| | |
|---|---|
| ***F21V 33/00*** | (2006.01) |
| ***E06C 7/00*** | (2006.01) |
| ***E06C 1/12*** | (2006.01) |
| ***E06C 7/08*** | (2006.01) |
| *F21Y 115/10* | (2016.01) |

(52) U.S. Cl.

CPC ..... *E06C 7/003* (2013.01); *E06C 1/12* (2013.01); *E06C 7/083* (2013.01); *E06C 7/087* (2013.01); *F21V 33/00* (2013.01); *F21Y 2115/10* (2016.08)

(58) Field of Classification Search

USPC ..... 362/234, 645, 294, 547, 451, 800

See application file for complete search history.

(56) References Cited

U.S. PATENT DOCUMENTS

| | | | | |
|---|---|---|---|---|
| 5,599,091 | A * | 2/1997 | Kira | F21V 21/30 362/269 |
| 5,954,154 | A * | 9/1999 | Ziolkowski | E06C 7/003 182/129 |
| 6,092,911 | A * | 7/2000 | Baker, III | A62C 27/00 169/24 |
| 7,174,994 | B1 * | 2/2007 | Coffield | E06C 1/39 182/129 |
| 2001/0015303 | A1 * | 8/2001 | Laug | E06C 7/48 182/107 |
| 2007/0019415 | A1 * | 1/2007 | Leblanc | F21V 5/003 362/299 |
| 2007/0221802 | A1 * | 9/2007 | New, Sr. | E06C 7/143 248/210 |
| 2010/0289415 | A1 * | 11/2010 | Chen | H05B 33/0803 315/185 R |
| 2011/0134642 | A1 * | 6/2011 | Lee | F21K 9/00 362/249.06 |
| 2011/0254450 | A1 * | 10/2011 | Bergholz | F21V 19/0015 315/121 |

(Continued)

OTHER PUBLICATIONS https://www.blesserhouse.com/2015/07/diy-ladder-light.html#comments (Jul. 8, 2015).*

*Primary Examiner* — Allyson Trail
(74) *Attorney, Agent, or Firm* — Schott, P.C.

(57) ABSTRACT

The ladder illuminates the immediate area and itself. The ladder improves safety by strategically adding multiple light sources to the ladder, thereby illuminating the areas around the ladder. Light emitting diodes (LEDs) may be mounted in several strategic locations, including: in-board and out-board of the end cap, under each rung, and out-board on both rails facing the base of the building when the ladder is correctly placed with a rechargeable battery supply.

19 Claims, 11 Drawing Sheets

(56) References Cited

U.S. PATENT DOCUMENTS

| | | | | |
|---|---|---|---|---|
| 2012/0182744 | A1* | 7/2012 | Santiago | F21S 8/026<br>362/365 |
| 2013/0140111 | A1* | 6/2013 | Desai | E06C 7/003<br>182/129 |
| 2014/0177258 | A1* | 6/2014 | Gebhard | B60Q 1/245<br>362/547 |
| 2014/0353081 | A1* | 12/2014 | Linch | E06C 7/003<br>182/18 |

* cited by examiner

LADDER WITH LIGHTS

BACKGROUND

Ground ladders are used in many situations in which access to heights is required. It is inherently dangerous to climb a ladder. This danger is compounded when ladders must be climbed in the dark, and is compounded exponentially when ladders are used to rescue occupants of buildings that are on fire.

SUMMARY OF THE EMBODIMENTS

The ladder with lights illuminates itself and the immediate surrounding area, improving safety by strategically adding multiple light sources to the ladder. Light emitting diodes (LEDs) may be mounted in several strategic locations, including: in-board and out-board of the end cap, under each rung, and out-board on both rails facing the base of the building when the ladder is correctly placed with a rechargeable battery supply.

DETAILED DESCRIPTION OF THE EMBODIMENTS

Figure 1:
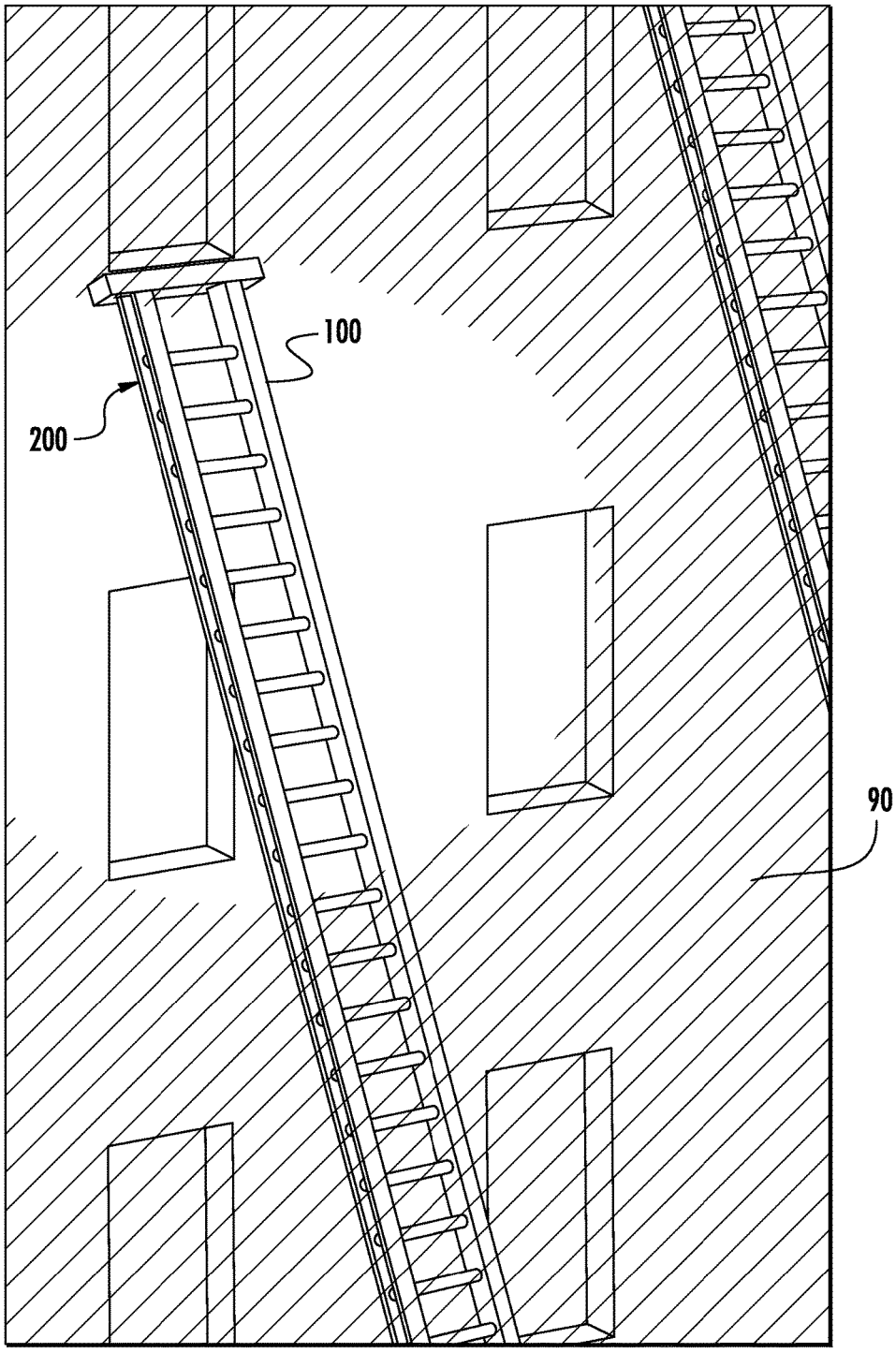
FIG. 1 is a perspective view of lights mounted to the end caps of the top of the ladder, or to the end caps of the fly section of a ground ladder when the ladder is placed for rescue of occupants from the room.

The components of the ladder with lights include: a ground ladder, a power supply, battery packs, and light emitting diodes (LEDs) strategically placed along the length of the ladder below rungs or on the underside of the rails. FIG. 1 shows the illumination of a building 90 when a ladder 100 is placed by firefighters making rescues. Lights 200 on the ladder are facing downward so that a person exiting the window onto the ladder 100 is not blinded by the light. His or her attention is directed toward the immediate task at hand, namely quickly and safely transiting the ladder 100 to the ground.

In FIG. 1, the illumination of the exterior of the fire building 90 gives critical information to the supervisors and safety officers, and all firefighters about both the structural stability of the building 90 and the conditions inside the building 90. The location of the lights 200 on an extended ladder 100 gives firefighters and others information in particular about the condition of the building at higher elevations.

In further detail, still referring to FIG. 1, the ladders 100 may use LEDs 200 that have high output (1000 lumens). Otherwise, the ladder's size, proportion, conditions of construction, and functional use may be substantially unchanged and thus, the LED lights discussed herein, while they may be made integral with a ladder, may also be retrofit to existing ladders.

Possible materials used in the construction of illuminated ground ladders include but are not limited to: LEDs encased in impact resistant plastic or metal, dual rechargeable battery packs, and fiber-optic cables to carry electric current.

Figure 2:
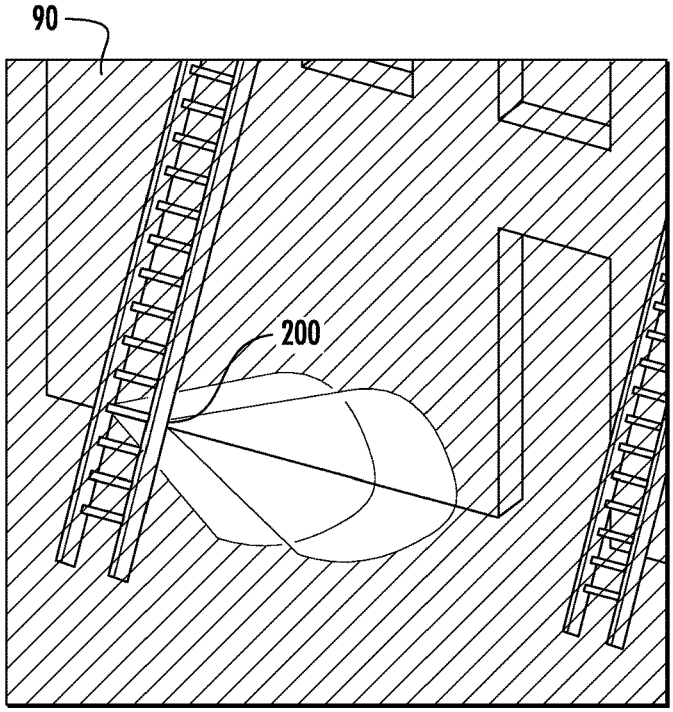
FIG. 2 is a perspective drawing of lights mounted to the lower section of the rails of a ground ladder illuminating the area and the ground under the ladder.

FIG. 2 shows the illumination of the base of the building by lights placed on both rails facing the base of the building. This improves the safety of those working on and under the ladder.

As seen in FIG. 2, lights placed on both rails facing the base of the building provide the added benefit of expediting the location of people who may have jumped out of windows of the burning building prior to the arrival of fire fighting forces.

FIG. 2 further demonstrates that the illumination of the lower foundation of the fire building 90 gives critical information to the firefighters and commanders about both the structural stability of the building and the conditions outside the building, including the locations of any people who may be at the base of the building.

Figure 3:
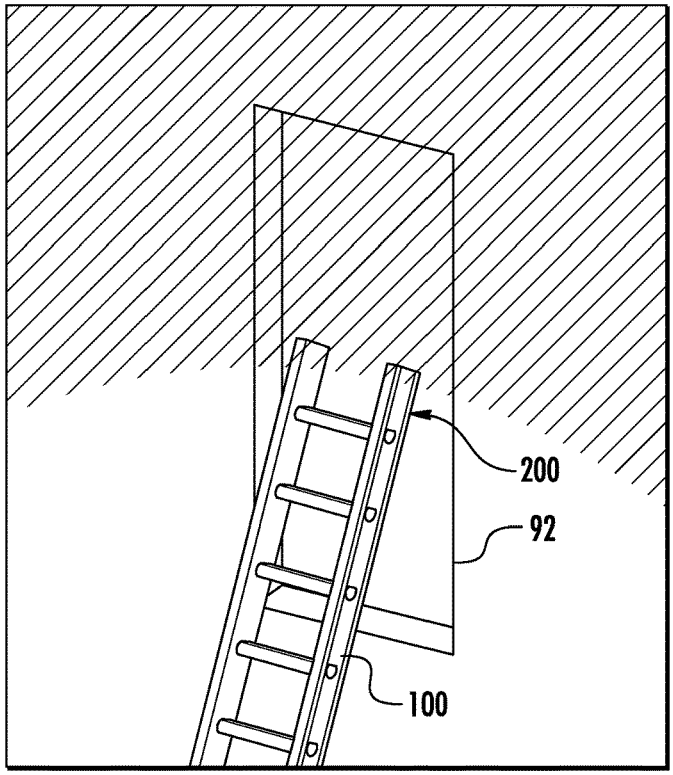
FIG. 3 is a perspective view of lights mounted to the end caps of the fly section of a ground ladder when the ladder is placed for entry into the room.

FIG. 3 shows the illumination of a window area 92 with a ground ladder 100 placement for access to the fire floor. The downward illumination of the lights 200 makes it possible for firefighters to determine the safety of a room's interior, and specifically the floor before entering the burning building 90.

As seen in FIG. 3, by placing downward-facing lights on the ladder, the beam of the light is not directed into the smoke, which could decrease visibility in the immediate area.

Additionally, referring to FIG. 3, the beam of light from the lights 200 illuminates the interior of the fire building 90, giving critical information, particularly about conditions inside the building.

Figure 4:
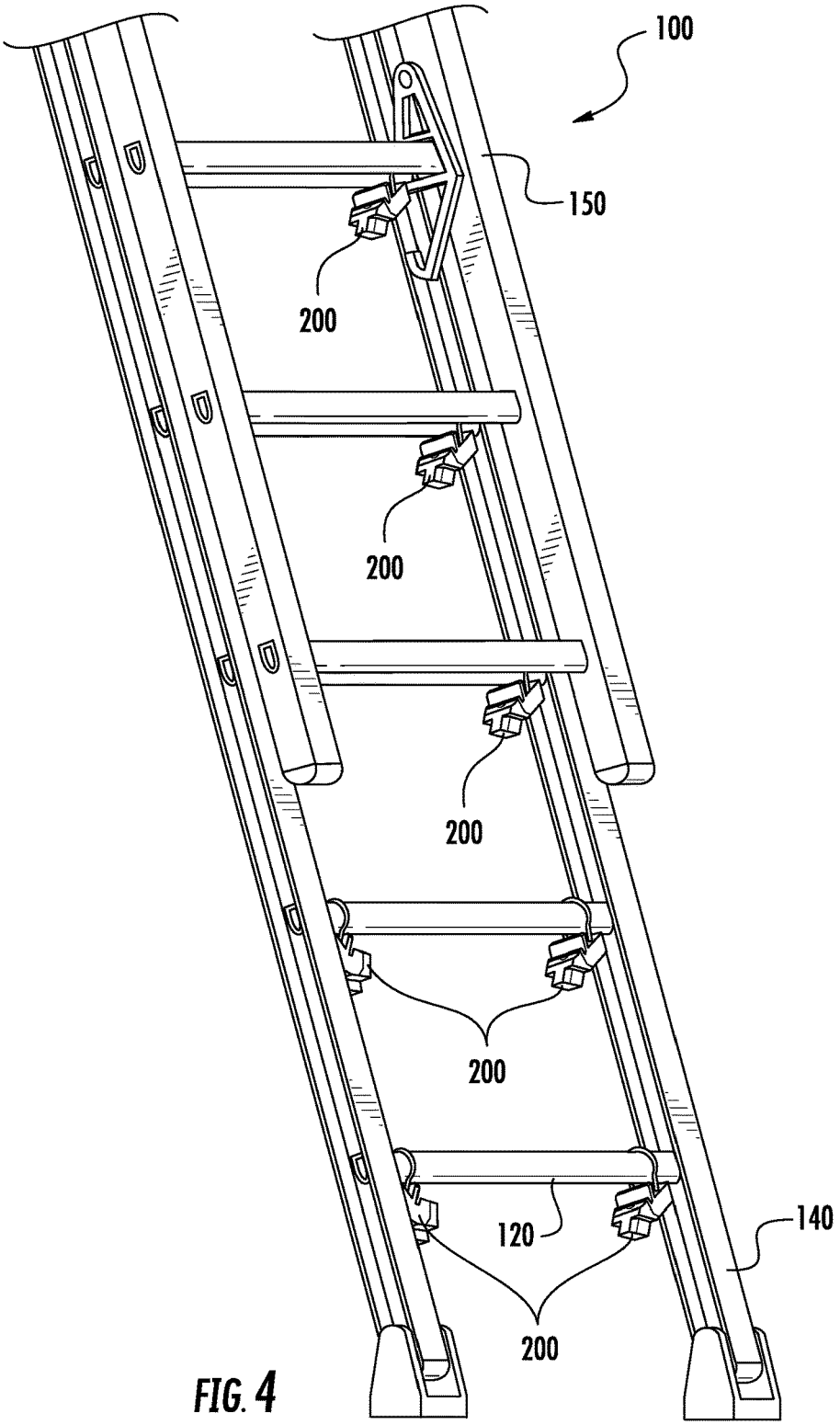
FIG. 4 is a perspective drawing of the lights mounted below the rungs at the junction of the rung and the rail.

FIG. 4 shows a ladder 100, which comprises rungs 120 attached via a plate 122 to rails 140. As shown, the lights 200 are located beneath each rung 120 and face inwards towards a building 90. The downward illumination of the lights 200 makes it possible for firefighters and civilians who are being rescued to quickly and safely descend a ground ladder 100 because they do not have to look down into a light shined up into their faces.

The beams of light emanating from beneath each rung 120 in FIG. 4 will also serve to illuminate the immediate area surrounding the ground ladder 90. It should be understood that in FIG. 4 and the figures that follow, the lights 200 may not be shown to scale and other sizes of lights 200 may be possible or desired.

Lights may be mounted to the end caps of the top of the ladder, or to the end caps of the fly section 150 of the ground ladder 100 when the ladder is placed correctly for ventilation.

The placement of the lights mounted to the end caps of the top of the ladder 100, or to the end caps of the fly section 150 of the ground ladder when the ladder is placed correctly for ventilation, provides hands-free illumination of the area where the firefighter is working.

Figure 5:
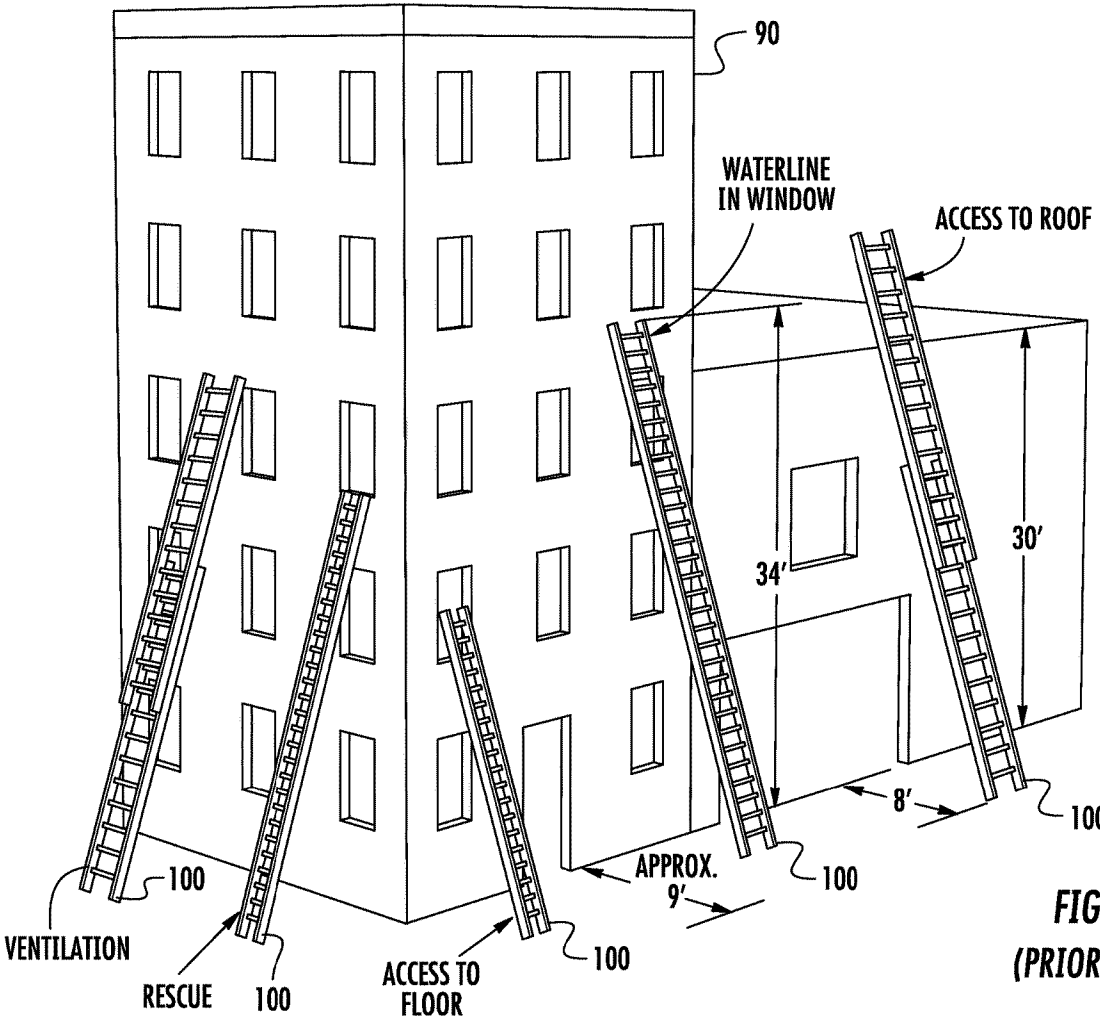
FIG. 5 (PRIOR ART)
FIG. 5 is for general reference, and is a perspective view of the various ways in which ground ladders are typically used in firefighting operations.
Figure 6:
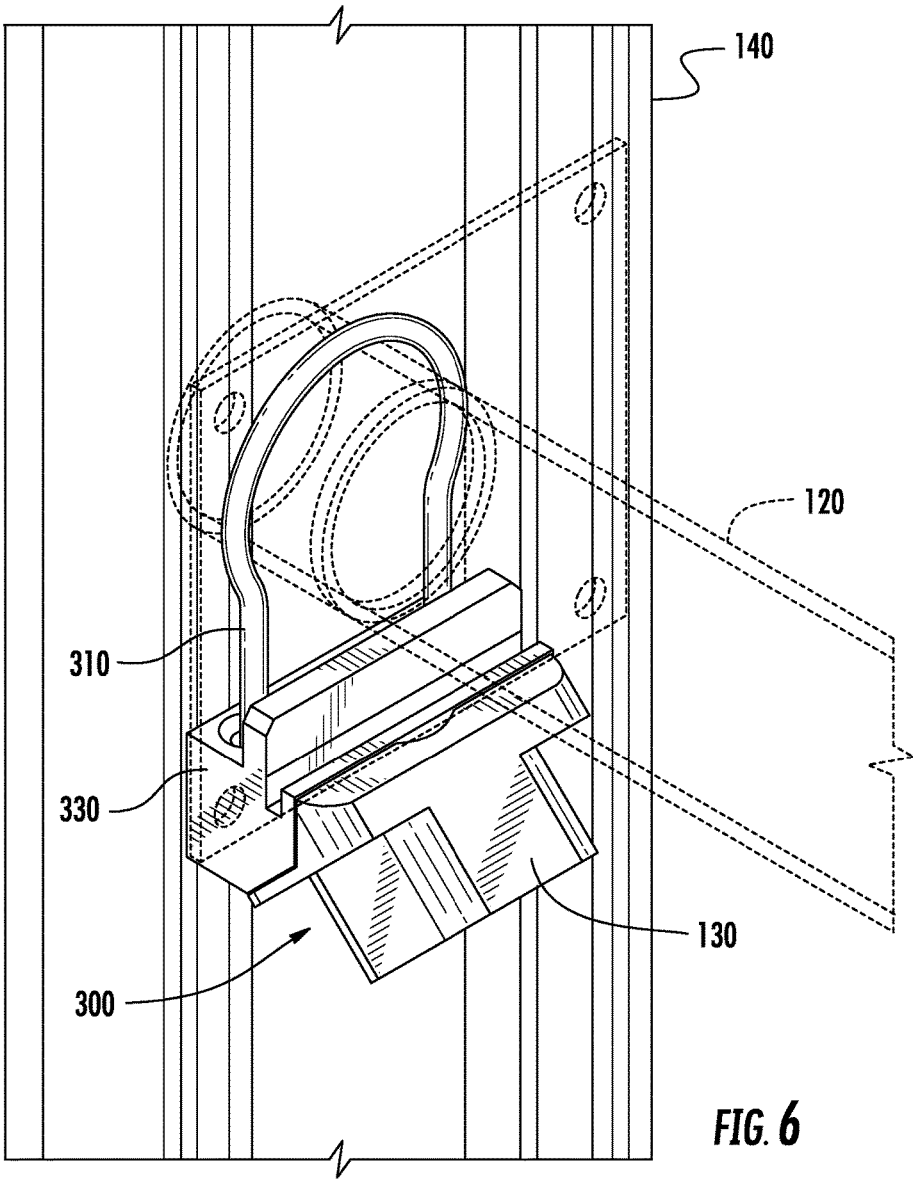
FIGS. 6-8 show an embodiment of a clip style LED light that mounts to a ladder rung.
Figure 7:
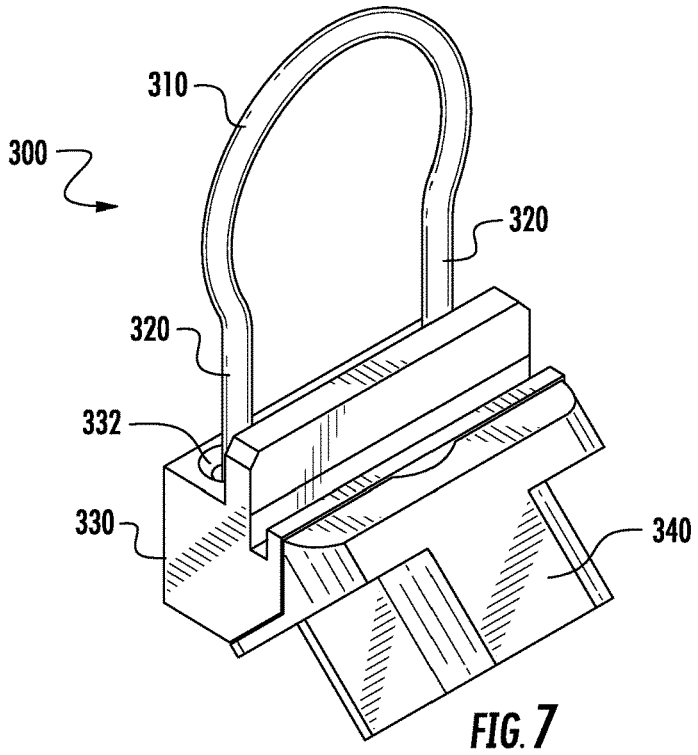
Figure 8:
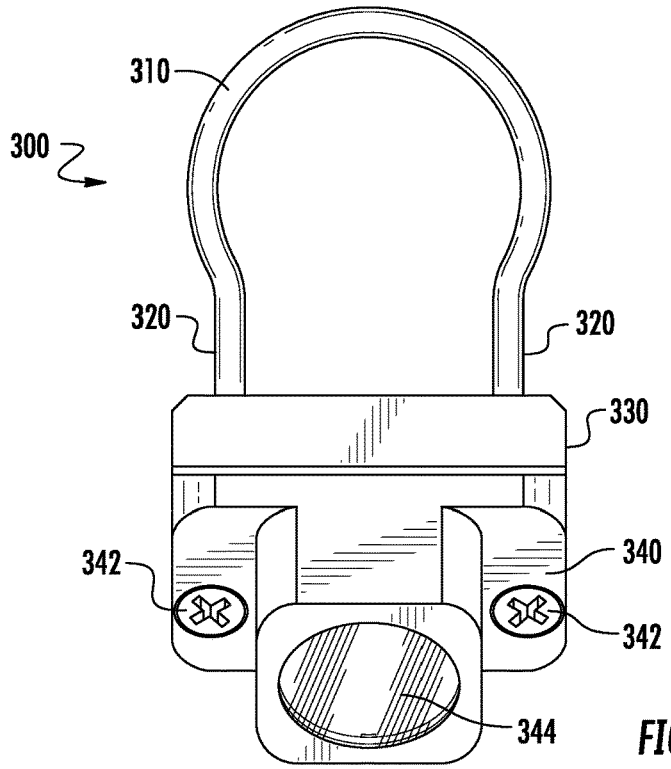
Figure 9:
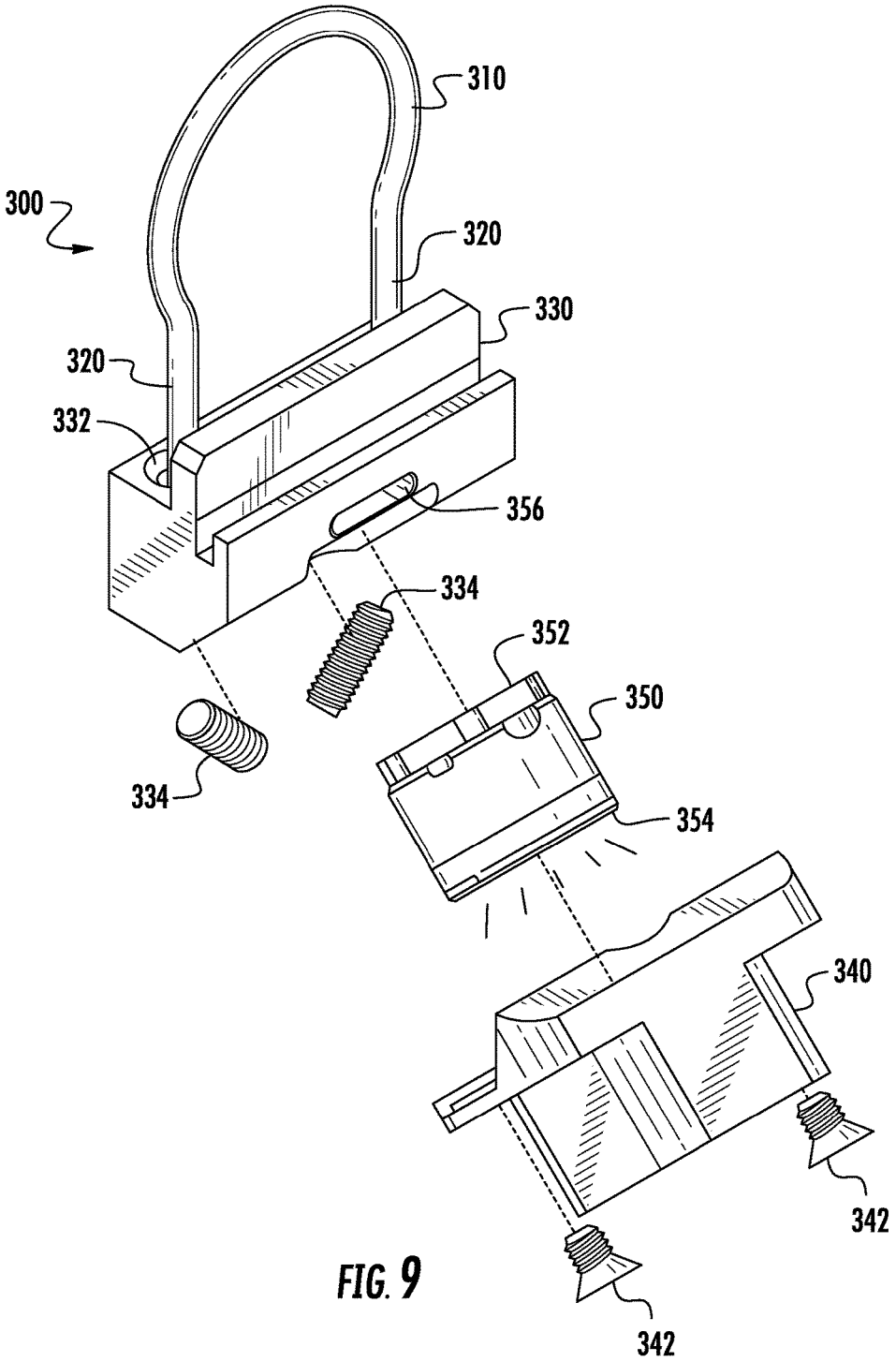
FIG. 9 shows an exploded view of the LED light of FIGS. 6-8.

FIG. 5 provides a perspective view of the various ways in which ground ladders are typically used in firefighting operations and is submitted for reference purposes. Ladders may be placed for ventilation, rescue, access to floor, access to roof or for waterline access in window, as required in a specific situation.

FIGS. 6-13 show multiple embodiments of the lights 200 as mounted to the ladder 90, and particular as the lights 200 mount to the rungs 120 or near the rung/rail engagement area.

FIGS. 6-9 show a clip-style LED clamp and light source 300 mounted to the ladder 100. This light 300 comprises a wire 310 that is expandable to slip over a ladder rung 120. The wire 310 has two ends 320 that extend into receiving holes 332 in a base 330. The wire 310 may be held in place within the base 330 by means of set screws 334 that extend into the base 330 at an angle and press against the clip's ends 320. A light housing 340 attaches to the base 330, as shown using two screws 342, although other attachment means would be possible. A removable light housing 340 may be advantageous because it allows for replacement of the light 350 without removing the wire 310 from the rung 120.

While described as a wire, the wire 310 may be a braided cable or even a metal or plastic clip. The form-flexibility of some of these materials would be helpful as it would allow the wire 310 to fit over different-sized rungs 120 or other portions of the ladder.

The light housing 340 has an opening 344 therein that allows for passage of light therethrough. The light is generated by an LED light 350 that at an interior star board 352 engages the base 330 and at the other lens end 354 emits light. The star board 352 and lens end 354 may be separate pieces engaged to one another. The LED light 350 may have an electrical connection through to the base 330, which holds a rechargeable battery or the battery may be within the light 350. Alternatively, the light sources 300 may be wired together and charged from a single battery located on or near the ladder.

The star board 352 may be grounded to base 330 through a wire (not shown) that may be soldered onto the star board 352 and connect thru a slot 356 in the base 330.

Each of the lighting units 300 may be connected to other light units on a ladder 100 such that lights can be controlled with one or more switches either on the ladder 100 or even remote from the ladder if the lights are connected to a remote controller by wifi, bluetooth or other wireless connection.

Figure 10:
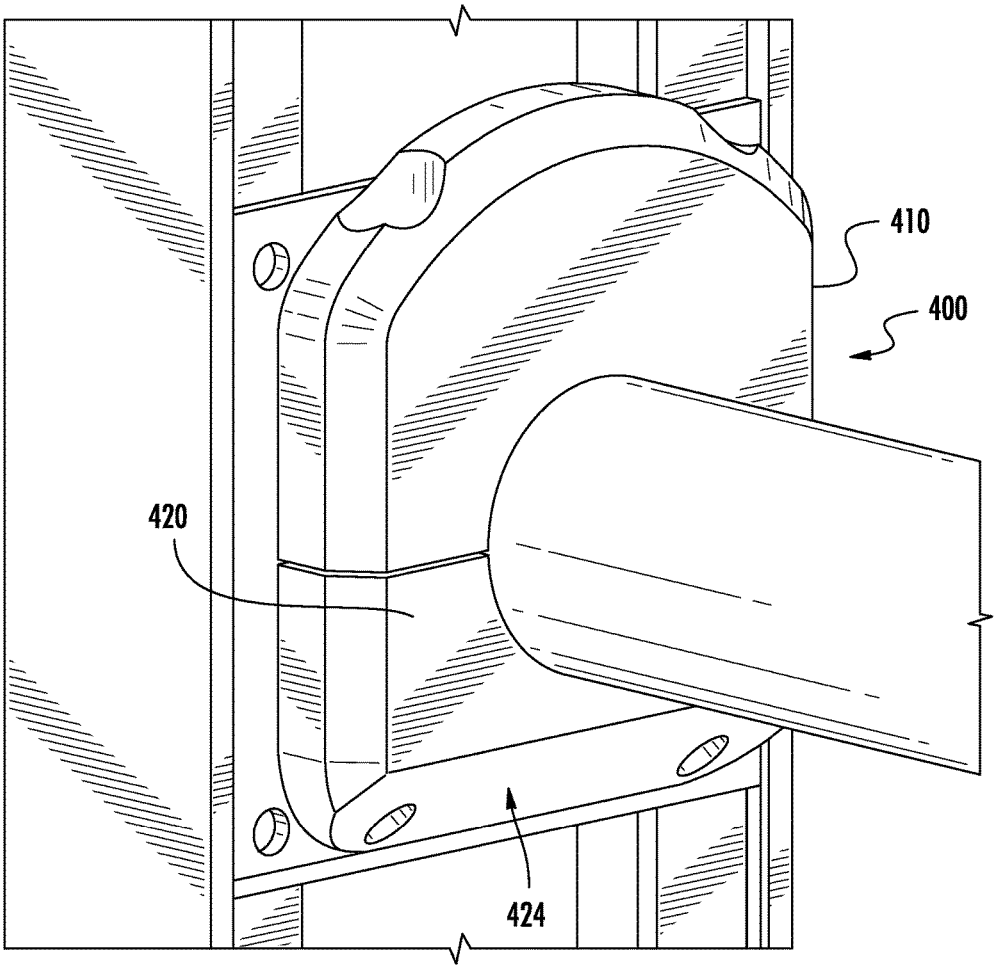
FIGS. 10 and 11 show a clamp-style LED light mounting on a ladder rung.
Figure 11:
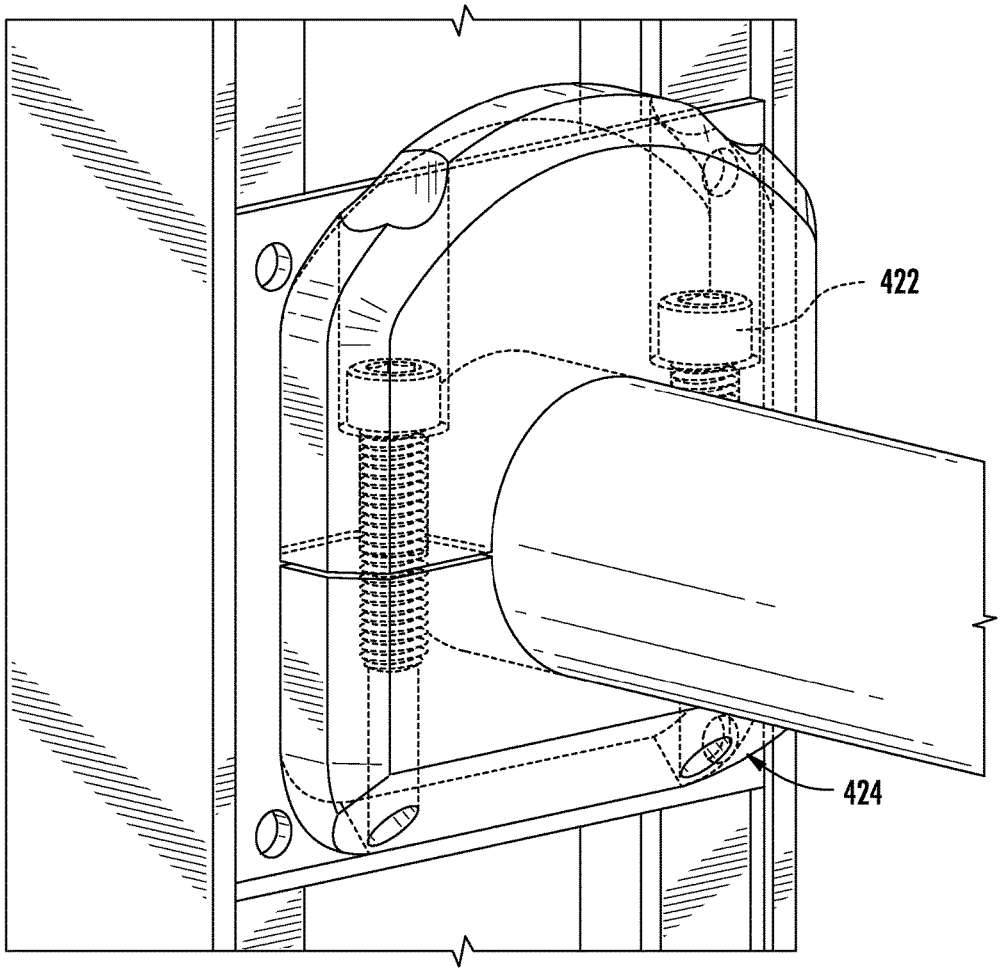

FIGS. 10-13 show different ways of attaching the light housing 340 and light 350 to a ladder 100. FIGS. 10 and 11 show a clamp 400 with a top portion 410 and bottom portion 420 that each have a half circle portion cut from them in order to engage a rung 120. The clamp 400 closes around the rung through engagement screws 422 that extend through the top portion 410 into the bottom portion 420. The bottom portion 420, as shown, has an angled surface 424 with holes that engage the lighting housing 340 and engagement screws 342, which holds the LED light 350.

Figure 12:
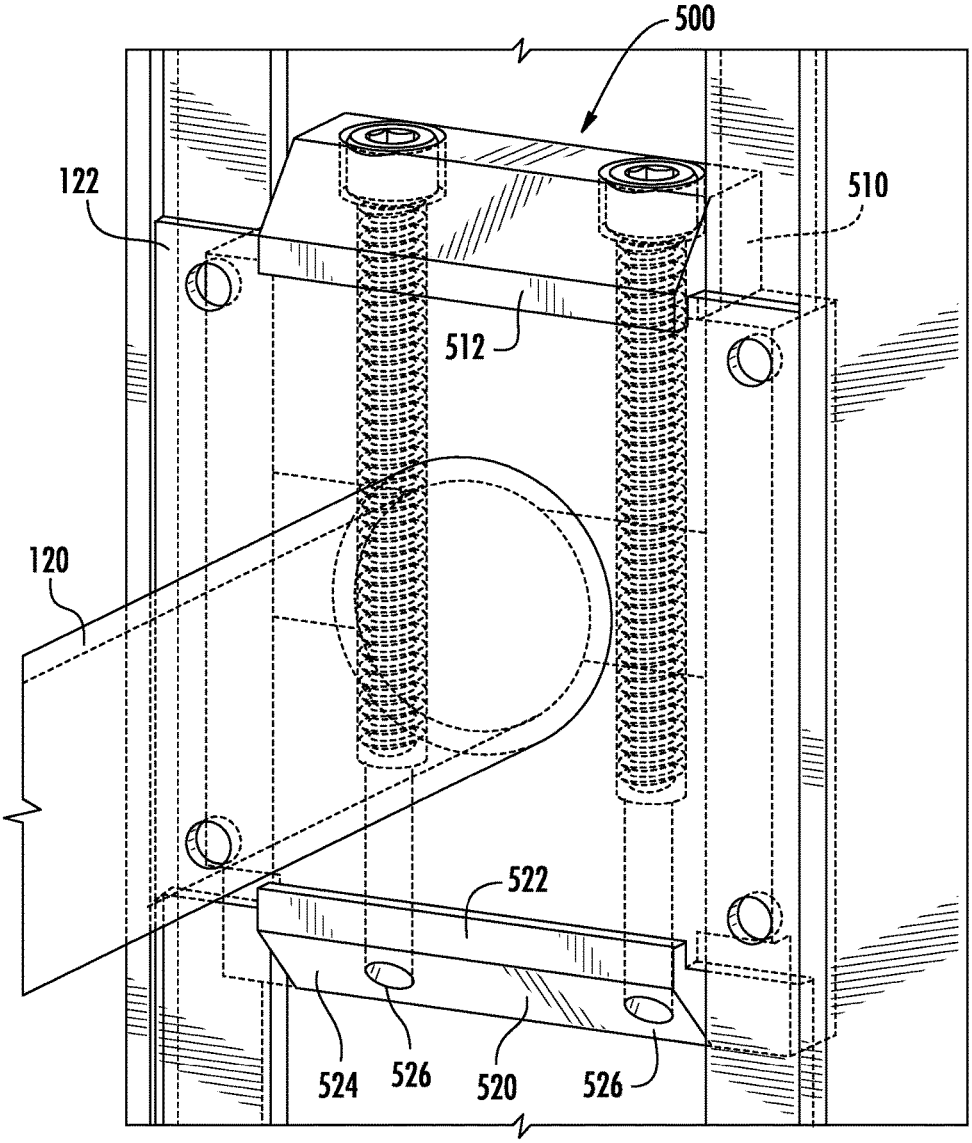
FIGS. 12 and 13 show a clamp-style LED light mounting on a ladder rung plate.
Figure 13:
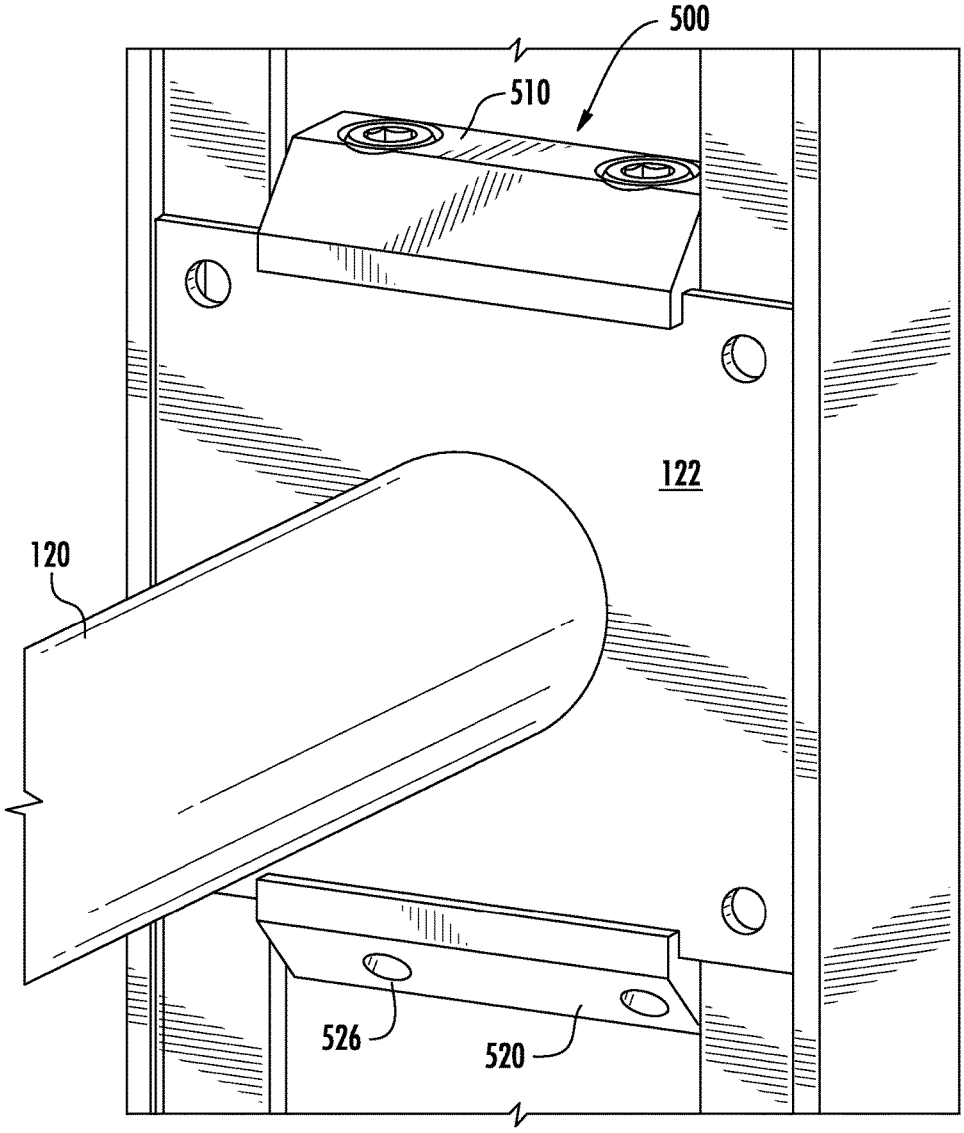

FIGS. 12 and 13 show an alternative engagement where a two-piece plate clamp 500 that has a plate clamp top portion 510 and bottom portion 520. Each portion slips behind a rung plate 122 and engages the plate 122 as top and bottom lips 512 and 522 slide over the plate 122 at respective ends of the clamp 500. The bottom portion 520, as shown, has an angled surface 524 with holes 526 that engage the lighting housing 340 and lighting housing screws 342, which holds the LED light 350.

While the invention has been described with reference to the embodiments above, a person of ordinary skill in the art would understand that various changes or modifications may be made thereto without departing from the scope of the claims.

The invention claimed is:

1. A lighted ladder comprises:

a ladder comprising rungs and siderails; and a light source engaged to the ladder through a wire engaged to the light source and encircling an end of the rung, wherein the light source comprises light emitting diodes (LEDs) and wherein the light source is aimed in a ground-ward direction.

2. The lighted ladder of claim 1, wherein the light source comprises a base that is engaged to a wire, and the wire forms the connection to the rung.

3. The lighted ladder of claim 2, wherein the wire has two ends, wherein each end connects to the base.

4. The lighted ladder of claim 3, wherein each end connects to the base securely using set screws that thread through the base.

5. The lighted ladder of claim 1, wherein the LED comprises two portions, a star board end portion that engages the base, and a lens portion that emits light.

6. The lighted ladder of claim 5, wherein the LED includes a grounding connection to the base, which in turn is electrically grounded to the ladder, wherein the LED is connected to the base via an LED housing.

7. The lighted ladder of claim 2, wherein the LED is connected to the base.

8. The lighted ladder of claim 7, wherein the LED comprises two portions, a star board end portion that engages the base, and a lens portion that emits light.

9. The lighted ladder of claim 8, wherein the LED includes a grounding connection to the base, which in turn is electrically grounded to the ladder.

10. The lighted ladder of claim 7, wherein the LED is connected to the base via an LED housing.

11. The lighted ladder of claim 1, wherein the light source comprises a base that clamps to an underside of a rung.

12. The lighted ladder of claim 1, wherein the ladder is a firefighting ladder.

13. The lighted ladder of claim 1, wherein the firefighting ladder is a ground ladder.

14. A lighted ladder comprises:

a ladder comprising rungs and siderails; and a light source engaged to the ladder, wherein the light source comprises light emitting diodes (LEDs) and wherein the light source is aimed in a ground-ward direction and wherein the light source is connected to an underside of the rung;

wherein the light source comprises a base that clamps to a base plate that encircles an end of one of the rungs and connects the rung to a ladder side rail.

15. The lighted ladder of claim 14, wherein the LED is connected to the base.

16. The lighted ladder of claim 15, wherein the LED comprises two portions, a star board end portion that engages the base, and a lens portion that emits light.

17. The lighted ladder of claim 16, wherein the LED includes a grounding connection to the base, which in turn is electrically grounded to the ladder, wherein the LED is connected to the base via an LED housing.

18. The lighted ladder of claim 14, wherein the ladder is a firefighting ladder.

19. The lighted ladder of claim 18, wherein the firefighting ladder is a ground ladder.

* * * * *